US005553545A

United States Patent [19]

Turner

[11] Patent Number: 5,553,545

[45] Date of Patent: Sep. 10, 1996

[54] PLATE CLAMPING AND TENSIONING APPARATUS FOR ROTARY PRINTING PRESS

[75] Inventor: Michael R. Turner, Renton, Wash.

[73] Assignee: Heath Custom Press, Inc., Renton, Wash.

[21] Appl. No.: 534,050

[22] Filed: Sep. 26, 1995

[51] Int. Cl.[6] ..... B41F 27/06

[52] U.S. Cl. ..... 101/415.1; 101/378

[58] Field of Search ..... 101/415.1, 410, 101/378

[56] References Cited

U.S. PATENT DOCUMENTS

| | | | |
|---|---|---|---|
| 2,850,971 | 9/1958 | Brodie | 101/415.1 |
| 3,855,025 | 12/1974 | Bosse | 156/582 |
| 4,157,067 | 6/1979 | Dätwyler | 101/415.1 |
| 4,223,604 | 9/1980 | Brehem et al. | 101/415.1 |
| 4,367,679 | 1/1983 | Ishii et al. | 101/410 |
| 4,727,807 | 3/1988 | Suzuki et al. | 101/415.1 |
| 4,831,931 | 5/1989 | Jeschke et al. | 101/415.1 |
| 5,142,305 | 8/1992 | Maslanka et al. | 346/138 |
| 5,182,994 | 2/1993 | Sugiyama et al. | 101/415.1 |
| 5,272,978 | 12/1993 | Wehle et al. | 101/415.1 |
| 5,325,778 | 7/1994 | Hartung et al. | 101/415.1 |
| 5,359,933 | 11/1994 | Blaser et al. | 101/415.1 |
| 5,440,989 | 8/1995 | Becker | 101/415.1 |
| 5,452,659 | 9/1995 | Pupic | 101/415.1 |

*Primary Examiner*—Eugene H. Eickholt
*Attorney, Agent, or Firm*—Dowrey & Associates

[57] ABSTRACT

A plate clamping system and apparatus for holding a flexible printing plate in position on a rotary printing cylinder. The system includes a plate clamp assembly mounted in a gap in the wall of the rotary printing cylinder for holding the leading edge of the flexible printing plate and a tail clamp assembly mounted in the same longitudinal gap in the cylinder wall for gripping and applying tension to the flexible printing plate to hold it against the surface of the printing cylinder. The plate clamp includes a plurality of individual clamping mechanisms which are air pressure engaged and spring released to hold the leading edge of the flexible plate. The tail clamp assembly includes a plurality of tail clamp mechanisms which are spring applied and air pressure released. The tail clamp mechanisms have a two-stage operation wherein compression springs clamp the tail end of the printing plate and a second set of tension springs moves the mechanism to apply tension on the printing plate. The air cylinders of the clamp assemblies are connected by separate single air pressure lines to a union on the rotary shaft of the printing cylinder with air pressure to the clamping assemblies being individually controlled by means of foot pedal operated air pressure control units.

19 Claims, 8 Drawing Sheets

PLATE CLAMPING AND TENSIONING APPARATUS FOR ROTARY PRINTING PRESS

BACKGROUND OF THE INVENTION

1. Field of the Invention

The present invention relates to rotary printing presses and more particularly to apparatus for holding a flexible printing plate in position on a rotary printing plate cylinder. The printing plate which comprises a flexible blanket holding the image that is to be printed is aligned and clamped at its leading end by a plate clamp mechanism and is engaged by a tail clamp mechanism at the trailing end. The tail clamp mechanism grips the tail end of the plate and applies tension causing the plate to lay flat against the cylinder.

2. Description of the Prior Art

In present day rotary printing presses flexible printing plates hold the image that is to be printed and the plates are held in position on rotary printing cylinders using various mechanisms. Generally, the leading edge of the plate is located in registry and securely held by a plate clamp and the trailing edge of the plate is held by a mechanism that applies tension on the plate to hold it against the surface of the rotary printing cylinder. These mechanisms generally consist of bars that extend axially across the cylinder adjacent the outer surface and contact the leading and trailing edges of the plate. This arrangement requires a large circumferential gap in the cylinder wall, limiting the effective printing surface area of the cylinder. In addition, the bar clamping mechanisms do not open widely enough, requiring the operator to insert the plate into an inconveniently narrow opening. The following listed U.S. patents are examples of prior art devices of the character described:

| U.S. Pat. No. | Patentee |
|---|---|
| 4,223,604 | Brehm et al. |
| 4,367,679 | Ishi et al. |
| 5,182,994 | Sugiyama et al. |
| 5,272,978 | Wehle et al. |

U.S. Pat. No. 4,831,931 to Jeschke et al. discloses another type of plate clamping apparatus wherein tensioning devices are located on both the leading and trailing end of the blanket. Although the Jeschke et al. patent as well as the Sugiyama et al. U.S. Pat. No. 5,182,994 listed above disclose examples of clamp actuating mechanisms utilizing either internal or external fluid or electrically driven motor means, most prior art sheet clamping and tensioning systems must be operated by hand using a tool or other device to tighten or loosen the clamping mechanism. U.S. Pat. No. 5,272,978 to Wehle et al. and U.S. Pat. No. 4,367,679 to Ishii et al. both utilize locking screws or rotary knobs to actuate the tensioning devices. U.S. Pat. No. 4,223,604 to Brehm et al. discloses still another type of operator typical of the hand operated key type. This type of actuation requires the operator to let go of the sometimes large and unwieldy plate to operate the clamping mechanism.

SUMMARY OF THE INVENTION

The present invention provides an improved clamping system for accurately locating, tensioning and clamping a flexible printing plate on the surface of a rotary printing cylinder. The system includes both a plate clamp assembly for aligning and gripping the leading edge of the printing plate and a tail clamping and tensioning assembly for the trailing edge of the plate. The entire system including both plate and tail clamp assemblies require a minimum of space and can be installed through a narrow longitudinal gap in the plate cylinder surface. The clamps or grippers of both assemblies are designed to open widely to facilitate the insertion of a plate end and are operated by air pressure with each clamping assembly requiring only a single air line. With this arrangement, the operator can use both hands to manipulate the plate, which can sometimes be large and unwieldy, while operating the clamping and release function of the mechanisms by means of a foot-pedal valve-operator.

To this end the clamping assemblies are both inserted through a longitudinal axially extending gap in the cylinder wall. Both clamping assemblies are demountably attached directly to the associated printing cylinder end wall forming the cylinder gap and bolted or otherwise secured thereto.

The plate clamp assembly for registering and clamping the leading edge of the plate comprises a plurality of identical clamping mechanisms mounted on an elongated plate with each individual clamping mechanism including a single acting pneumatic cylinder. The pneumatic cylinders are all operated from the same air pressure line connected through a rotary union in the end of the rotary printing cylinder with the application and release of air pressure being controlled by a foot pedal switch. The plate clamp assembly for gripping the leading edge of the plate consists of a plurality of individual clamp mechanisms mounted on a single bar which is demountably fixed to the plate cylinder wall with appropriate skew adjustment. Each clamping mechanism includes a clamp element for engaging the plate with the clamp element being pivotally mounted and moved into clamping relationship by means of a cam roller connected to an air cylinder. The plate clamp remains in clamping relationship as long as the air cylinder is actuated and, upon release of air pressure, is caused to release by means of spring action.

The tail clamp assembly comprises a plurality of tail clamp mechanisms mounted to a single tail clamp bar which is demountably connected to the rotary printing cylinder closely adjacent to the plate clamp assembly. Each tail clamp mechanism includes a tiltable segment and a rotatably mounted tail clamp element. A two-stage linkage mechanism holds the tail clamp element in engagement with the plate end and the tiltable segment by means of tension springs. The tail clamp is released by means of an air cylinder which, through the two-stage linkage first causes the tiltable segment to rotate toward the rotary plate cylinder releasing tension on the plate and then to move the tail clamp element in a released position away from the tiltable segment. When it is again desired to mount a plate and, with the tail clamp element in the release position, the tail end of the plate is located between the clamp element and the tillable segment, the air pressure is released retracting the cylinder and causing a first set of compression springs to move the tail clamp against the tiltable segment clamping the tail end of the plate. The tiltable segment is then pulled away from the printing cylinder by tension springs to tighten or stretch the plate on the surface of the cylinder.

DESCRIPTION OF THE PREFERRED EMBODIMENT

Figure 1:
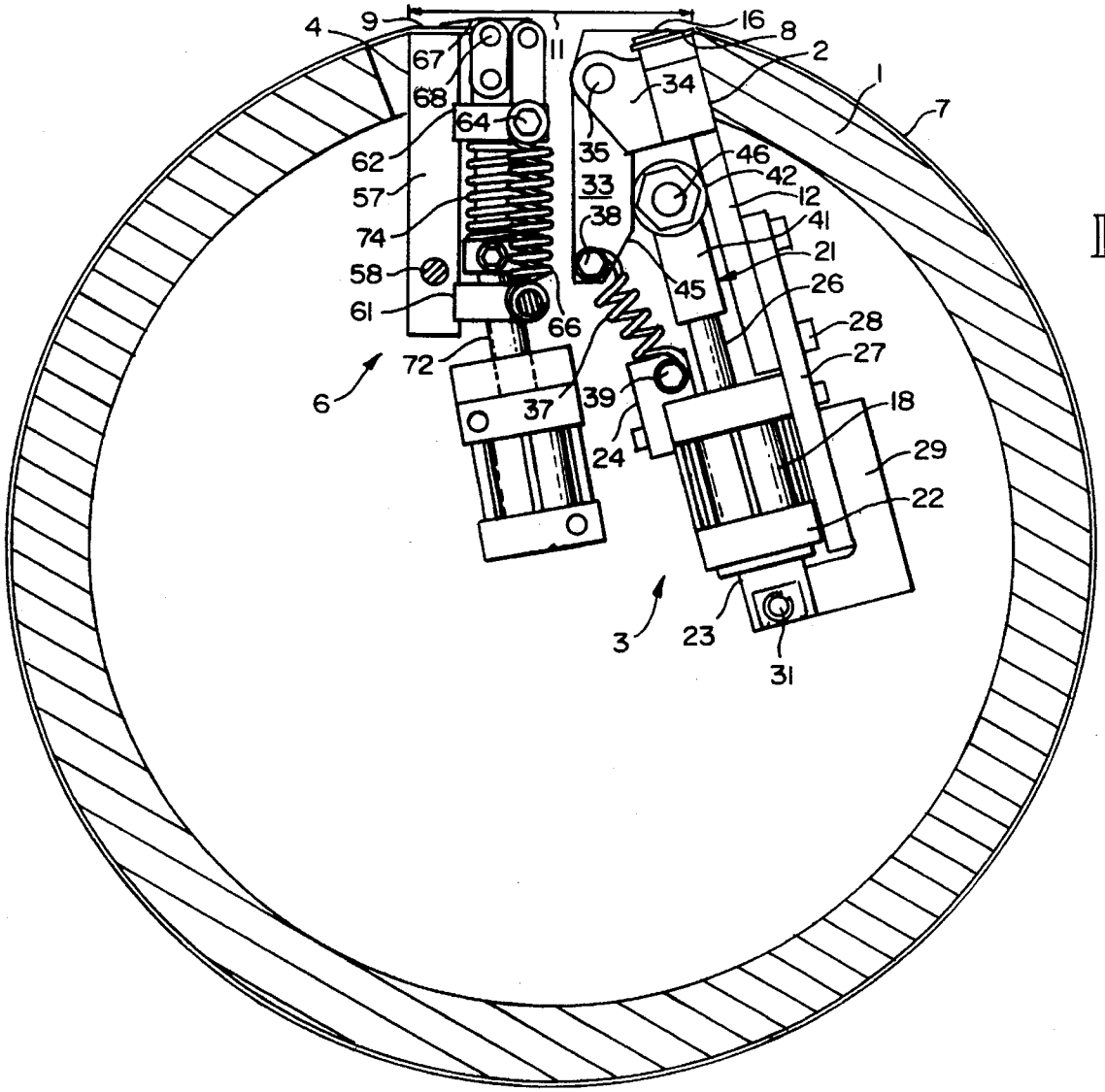
FIG. 1 is a partially sectioned end elevation of the clamping assemblies mounted on the printing cylinder.

Referring to FIG. 1, the plate cylinder 1 which, for ease of illustration, is shown in section only is provided with an axially extending longitudinal gap or opening which may be milled or otherwise formed in the cylinder wall. The gap is defined by a first cylinder end wall surface 2 for attaching the plate clamp assembly 3 and a second cylinder end wall surface 4 for receiving the tail clamp assembly 6. The flexible printing plate or blanket 7 is secured at its leading end 8, referring to the direction of rotation of the cylinder, wraps tightly around the cylinder 1 and is clamped and tensioned at the tail end 9 by the tail clamp assembly 6. The cylinder gap 11 is thus defined by the distance between the surfaces 2 and 4.

Figure 2:
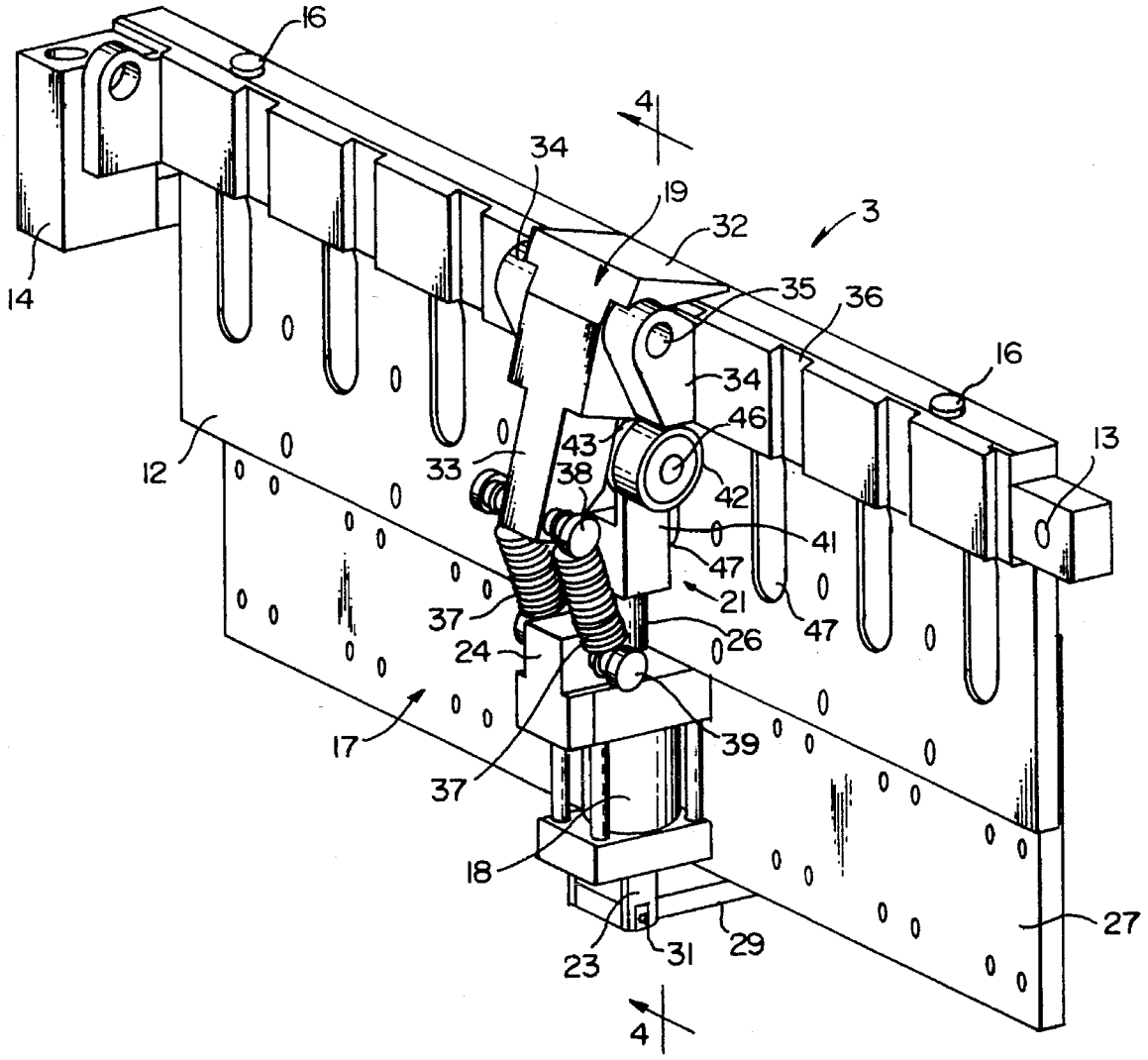
FIG. 2 is a perspective view of the plate clamp mounting bar with a single clamp mechanism mounted thereon.
Figure 3:
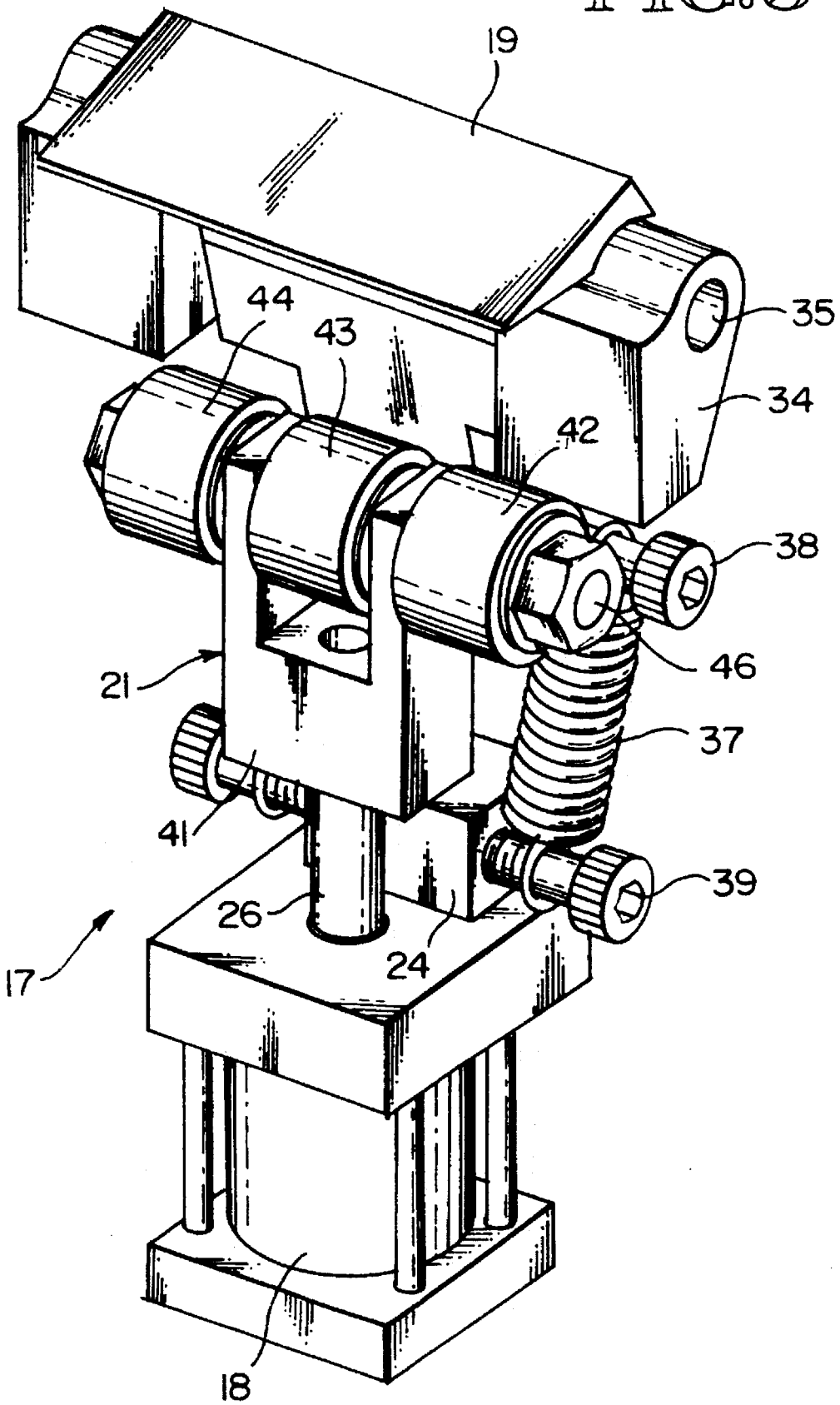
FIG. 3 is a perspective view of a single plate clamp mechanism.
Figure 4:
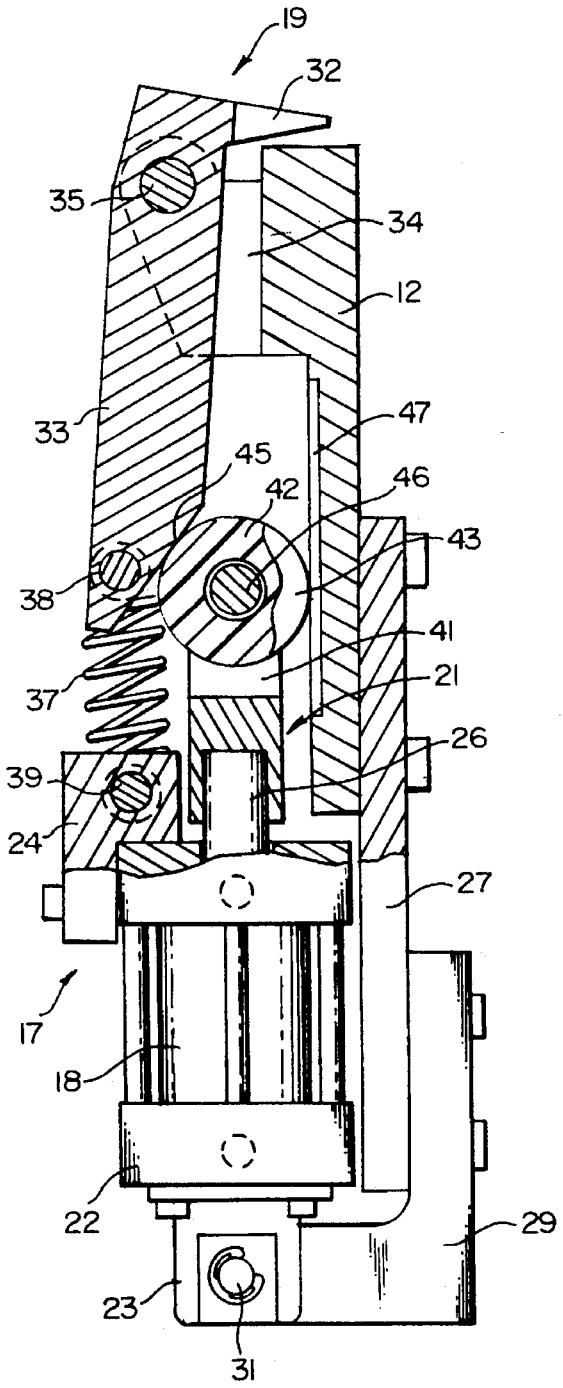
FIG. 4 is a cross sectional view taken along lines 4—4 of FIG. 2 showing the clamp plate in the released position.
Figure 4A:
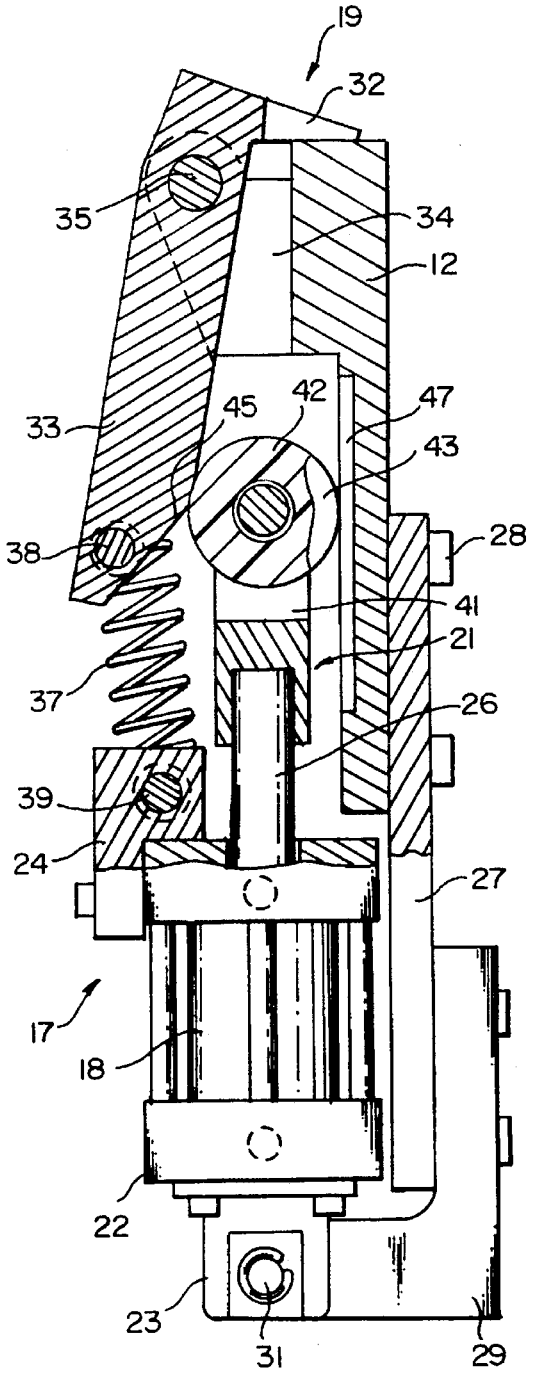
FIG. 4A is a cross sectional view similar to FIG. 4 showing the clamp plate in the clamped position.

Referring to FIG. 2, the plate clamp assembly 3 comprises a plate clamp mounting bar 12 which is bolted or otherwise fixedly attached to the cylinder wall adjacent the end surface 2. The bar 12 may be bolted at one end by means of a mounting block or the like utilizing the mounting hole 13 with the opposite end of the bar including a mounting block 14 with suitable arrangements for skew adjustment as is well understood in the art. The bar 12 is thus fixed to the end 2 of the cylinder 1 and extends axially along the gap 11 in adjusted fixed relation. The bar 12 also includes the usual register pins 16 for engaging slots or holes in the printing plate for proper alignment. As shown in FIG. 2, the mounting bar 12 is designed to mount a plurality of individual plate clamp mechanisms 17 presently to be described in detail. As depicted in FIG. 2, only one such plate clamp mechanism 17 is illustrated with the understanding that, in the present embodiment, eight such plate clamp mechanisms will be spaced along the bar 12 at the indicated locations. Each plate clamp mechanism includes its own actuating air cylinder 18, a clamping element 19 and a roller cam actuator mechanism 21 connected to the piston rod of the cylinder 18. Details of the air cylinder 18 are shown in FIGS. 4 and 4A and include a rigid mounting frame 22 with spaced pivot arms 23 on its lower end as viewed in the drawings and an anchor block 24, providing a connection point for the return spring apparatus to be described. The piston rod 26 of the air cylinder is rigidly connected to the roller cam assembly. Air cylinder 18 is provided with a mounting plate 27 which is fixed by means of bolts or the like fasteners 28 to the backside of the bar 12. Each individual air cylinder 18 is connected to the plate 27 via a rigid mounting arm 29. A pivot pin 31 connects the mounting arm to the arms 23 of the cylinder. The air cylinder 18 is thus pivotally mounted relative to the plate clamp mounting bar 12.

The clamp element 19 includes the plate contact member 32 and the operating arm 33. The clamping element is pivotally mounted between the blocks 34 which are fixed to the bar 12 in the slots 36 provided. With this arrangement the clamping element may be moved to the plate clamping or engaged position shown in FIGS. 1 and 4A, with the plate contact member 32 clamping the end of the plate 7 against the top edge surface of mounting bar 12, or to the release at position shown in FIG. 4 as it rotates about the pivot pin 35. The clamp element is normally held in the released position of FIG. 4 by means of the tension springs 37 which connect the end of the arm 33 to the anchor block 24 by means of the connecting pins 38 and 39 respectively.

The clamping arm is moved and held in the clamping position under air pressure by means of the roller cam assembly 21. The roller cam assembly comprises a clevice 41, connected to the piston rod 26, which mounts the three rollers 42–44 on the axis shaft 46. As seen most clearly in FIGS. 2 and 4 the mounting bar 12 is provided with depressions or cut-out areas 47 beneath the center cam roller 43 to accommodate linear movement thereof. The two outside rollers 42 and 44 ride on the surface of the bar 12 on either side of the clevice 47 as the piston rod extends. With this arrangement, the clevice 47 is supported in its linear motion by the support rollers 42 and 44 while the center cam roller 43 is held out of engagement with the bar 12 and contacts the cam surface 45 and the underside of the operating arm 33. As the piston rod 26 extends, the roller 43 moves the clamp element toward the closed clamped position shown in FIG. 4A against the tension springs 37. The plate clamping element 19 is thus held in the engaged position shown in FIG. 4A by the application of air pressure with extension of the piston rod 26. Upon release of air pressure an internal spring within the cylinder 18 (not shown) returns the piston rod and the tension springs 37 again pivot the clamping element 19 to the position shown in FIG. 4 to release the plate.

Figure 5:
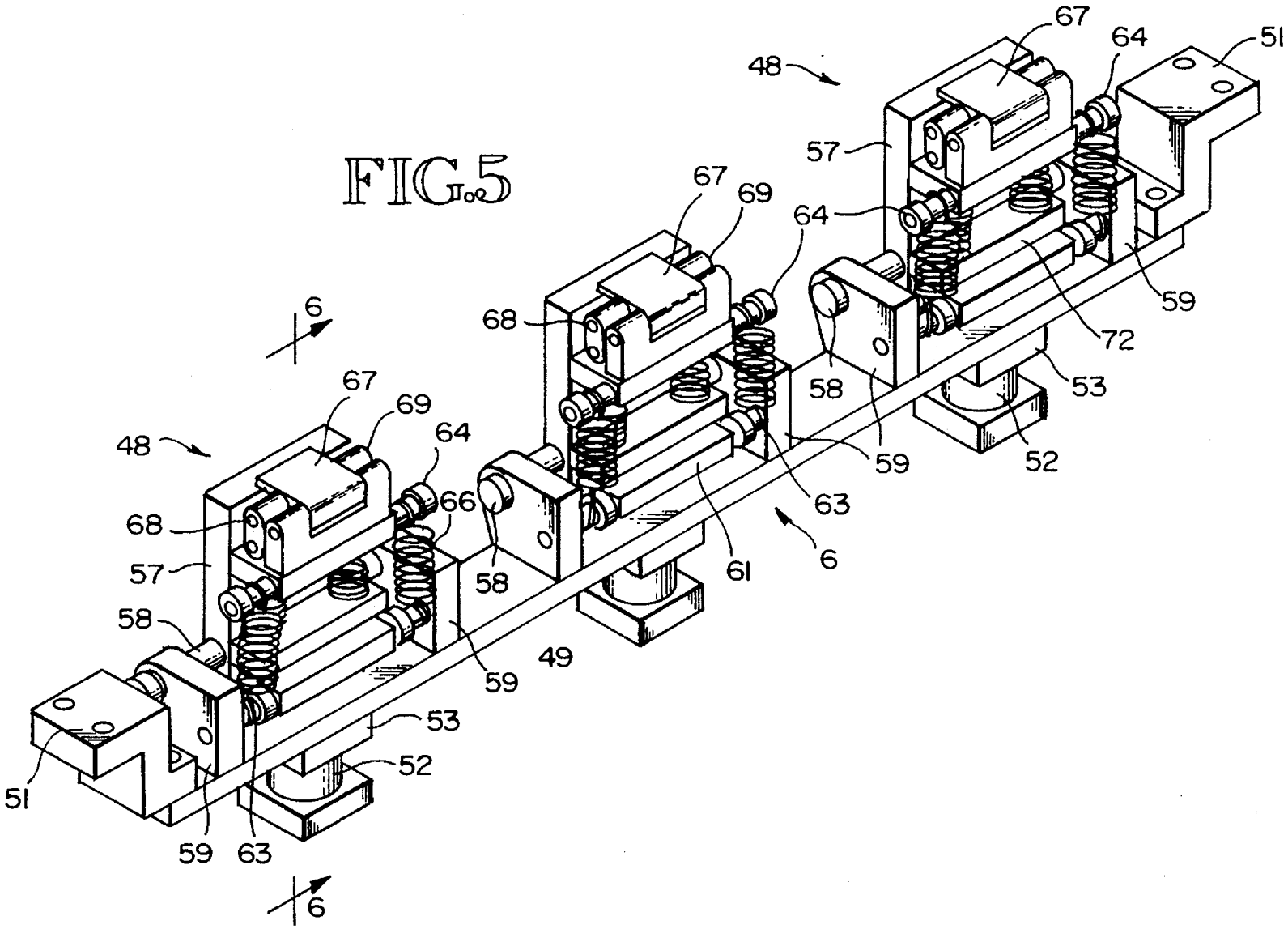
FIG. 5 is perspective view of the tail clamp mounting bar with tail clamp mechanisms mounted thereon.
Figure 6:
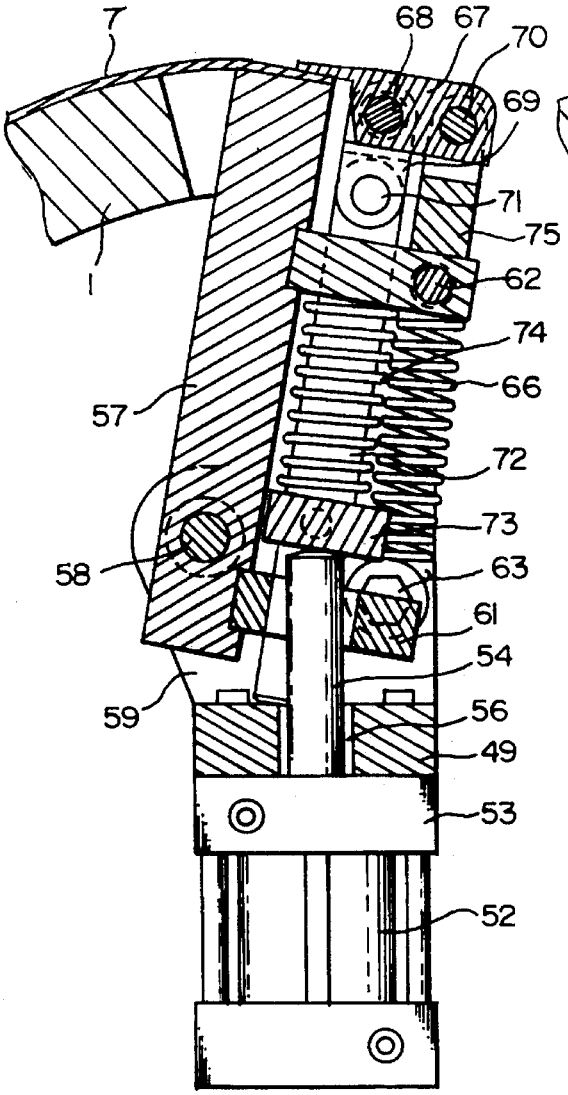
FIG. 6 is cross sectional view taken along lines 6—6 of FIG. 5 showing the tail clamp in the clamped and tensioned position.

The complete tail clamp assembly and tail clamp mechanisms are shown in detail in FIGS. 5 and 6. As shown in FIG. 5, the present embodiment includes three tail clamp mechanisms 48 mounted on the tail clamp mounting bar 49. It will be understood that the three tail clamp mechanisms 48 may be identical and only one mechanism will be described in detail. The mounting bar 49 will be demountably fixed to the printing cylinder 1 by means of the mounting blocks 51 located on opposite ends of the bar. The bar of course will extend along the cylinder end wall 4 as shown in FIG. 1 to engage and apply tension to the tail end of the plate 7.

Each tail clamp mechanism 48 includes its own air cylinder 52 carried in a mounting frame 53 secured by bolts or the like to the bottom side of the mounting bar 49. The cylinder has a piston rod 54 extending through a clearance opening 56 in the body of the bar 49. The opening 56 provides ample clearance for free movement of the piston rod 54.

The main body of the tail clamp mechanism comprises a tilt bar 57 which extends substantially at right angles to the mounting bar 49 and is pivotally mounted on a pin 58 extending between the upright mounting blocks 59 carried by the bar. The tilt plate 57 has two vertically spaced cross bars 61 and 62 fixed thereto for a purpose to be described. The mounting blocks 59 also include attachment pins 63 which extend inwardly through the blocks and terminate short of the location of the lower crossbar 61. The upper crossbar 62 includes a second set of attachment pins 64 which extend laterally outwardly from the bar and, along with the pins 63 provide attachment points for the two tension springs 66 located on either side of the tail clamp mechanism. As can be seen most clearly in FIG. 6, the springs 66 normally hold the tiltbar 57 in the clockwise or clamped position of rotation to maintain tension on the plate 7. This is also the position which holds the tail clamp element against the tilt bar 57 with the plate 7 being captured between the element 67 and the upper end of the tilt bar presently to be described.

The tail clamp element 67 is pivotally connected by the cross pin 68 to the links 69 at one end and by the pin 70 at the opposite end to a block 75. The links 69 are in turn pivotally mounted on cross pins 71 on the respective upper ends of the vertical guide posts 72. The posts 72 are mounted for reciprocal movement in suitable openings in the lower and upper bars 61 and 62 respectively. A rigid pressure bar 73 is connected between the posts 72 by means of set screws or the like. The bar 73 remains in contact with the piston rod 54 and each guide post 72 is surrounded by a compression spring 74 which acts between the pressure bar and the upper crossbar 62 carried by the tilt bar 57.

Figure 6A:
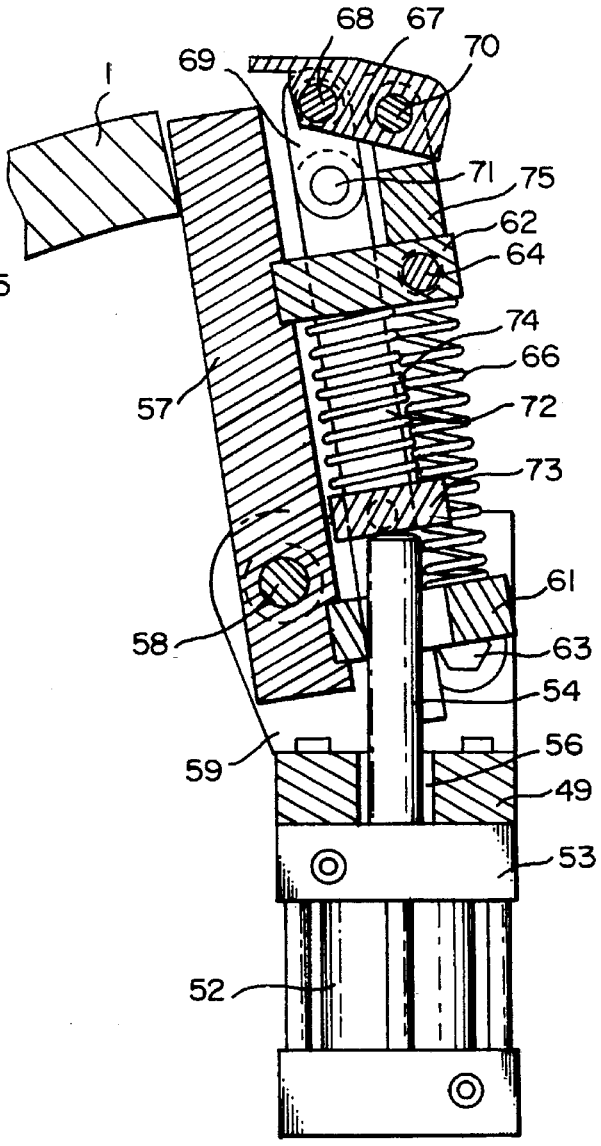
FIG. 6A is a cross sectional view similar to FIG. 6 showing the tail clamp in the released position.

In the clamped or engaged position of the tail clamp shown in FIG. 6 the described structure causes the posts 72 to be pressured downwardly with the surface of the mounting bar 49 being the limit of travel in order to hold the clamping element 67 firmly against the upper end of the tilt bar 57. In the FIG. 6 position, the piston rod 54 of the air cylinder is moved to the retracted position by means of a return spring (not shown) within the cylinder. As the piston rod 54 extends to the clamp release position shown in FIG. 6A it first causes the tilt bar to rotate counterclockwise against springs 66 to release the tension on plate 7. Further movement of the piston rod compresses the springs 74 by moving the pressure bar 73 towards the fixed cross bar 62 and raising the posts 72. This action causes the clamp element 67 to pivot about the pin 70 releasing the grip on the plate 7.

To install a plate, the plate end is placed between the element 67 and the upper end of the tilt plate 57 and air pressure released. When the air pressure is released, the piston rod 54 retracts, the springs 74 close the element 67 clamping the plate and the tension springs 66 again tilt the bar 57 away from the end of the cylinder wall tensioning the plate 7.

Figure 7:
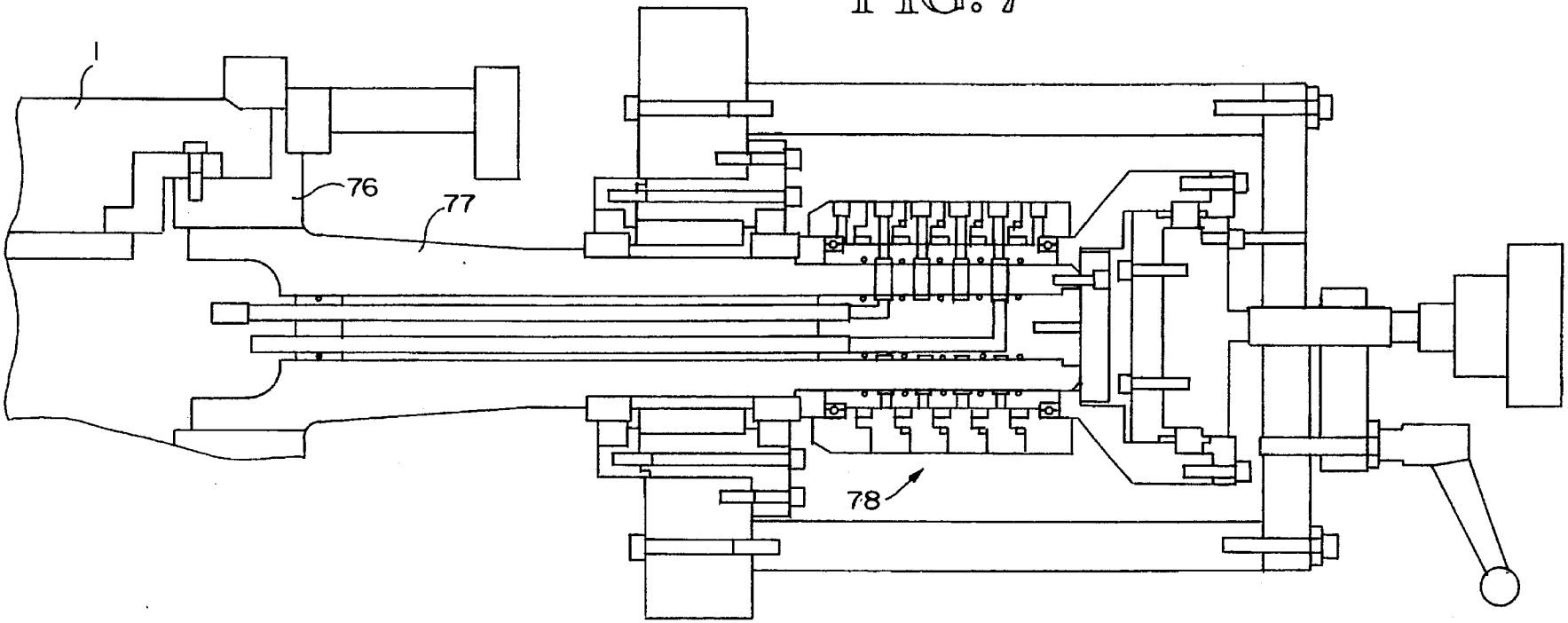
FIG. 7 is a partially sectioned elevation showing the axial mounted rotary union for supplying air pressure to the FIG. 8 is a cross sectional detail of the rotary union and schematic foot pedal switch control.
Figure 8:
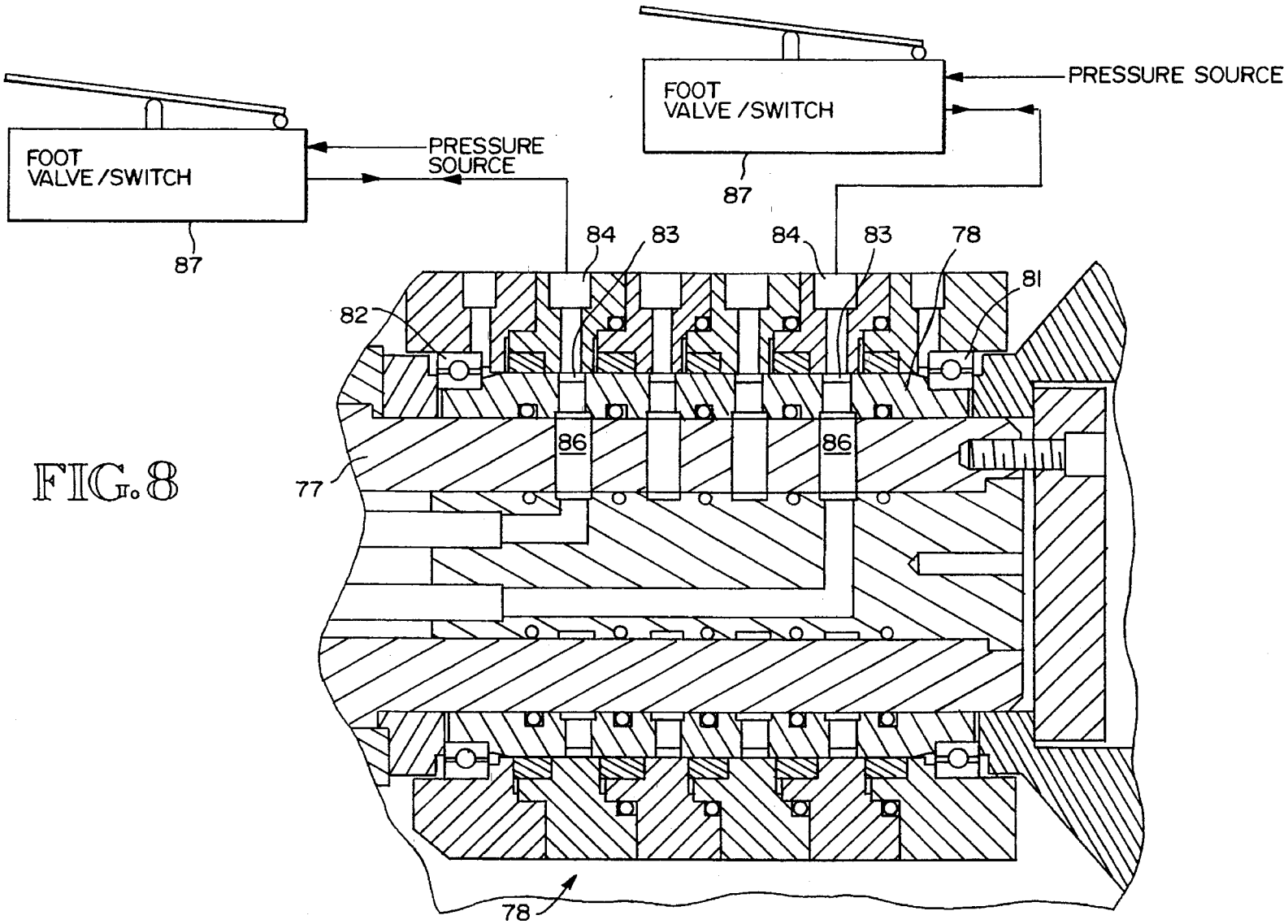

FIGS. 7 and 8 illustrate the rotary union for the printing cylinder which connects an air pressure source to the air lines for the air cylinders of both the plate clamp and tail clamp mechanisms. As shown in FIG. 7 the cylinder 1 is rigidly connected to a barer plate 76 connected to the stub shaft 77 which is rotatably mounted on suitable bearings in a manner well understood in the art. The union, indicated generally at 78 is stationary and surrounds the ported collar 79 mounted on the distal end of the rotating stub shaft 77 by means of the bearing assemblies 81 and 82. The collar 79 includes annular grooves 83 communicating with the air pressure ports 84 in the union 78 and the air passages 86 in the rotatable stub shaft 77. The air passages 86 are connected to the respective air cylinders 18 and 52 by appropriate piping as illustrated. In this manner air pressure may be introduced into the passages 86 and to the banks of plate clamp air cylinders 18 and tail clamp cylinders 52. Air pressure in the respective air cylinders is also relieved by the same passages. In order to control the application and release of air pressure on the clamp cylinders, each port 84 is connected to a foot valve/switch control unit shown schematically at 87 in FIG. 8. Since the plate clamp mechanisms 3 and tail clamp mechanisms 6 are actuated and released independently, each port 84 will be provided with its own foot valve/switch control unit. The details of the control units 87 may take any form such as a switch for controlling a solenoid valve operator or may comprise the valve itself. In any case the foot pedal operated units will be capable of applying air pressure from a pressure source and venting the pressure line to relieve the actuator cylinders through the single line.

Operation

As previously described, the complete plate clamp assembly 3 and the tail clamp assembly 6 are both inserted through the narrow gap 11 and mounted to the end walls of the printing cylinder. The bank of the air cylinders 18 will all be connected to a single air pressure line and likewise the individual air cylinders 52 of the tail clamp assembly will be connected to a separate single air line. Each air pressure line is connected to a pressure source through the union 78 and the foot valve/switch units 87. When it is desired to mount a flexible printing plate 7 to the printing cylinder, the operator steps on one of the foot pedal units 87 which normally maintains pressure on the cylinders 18 to hold the clamping element 19 in the clamping position. The foot pedal unit is operated to vent the cylinders 18, allowing the piston rods to retract by spring pressure. With the air pressure removed, the springs 37 cause the clamping elements to move to the open position shown in FIG. 4 permitting the operator to place the printing plate into the open clamp mechanisms. The plate is aligned by means of the register pins 16 in a well known manner. It will be understood of course that other means of registering or aligning the printing plate on the cylinder may be utilized. The operator then releases the foot pedal which results in the application of air pressure to the cylinders 18 causing the piston rod 26 and cam rollers to extend, forcing the plate clamp element to move to the clamping position shown in FIGS. 1 and 4A against the tension of springs 37. The plate clamp assemblies will remain in the clamped position so long as air pressure is maintained in the cylinders 18.

Once the plate clamp assembly is engaged with the leading end of the printing plate, the cylinder 1 is rotated until the flexible plate 7 is wrapped around the cylinder and the trailing or tail end is brought near the tail clamp assembly 6. As previously described, the tail clamping mechanisms 48 are normally held in the clamping position shown in FIG. 6 by action of the compression springs 74 and the tension springs 66. The operator therefor initially operates the appropriate foot valve unit 87 which provides air pressure to the individual cylinders 52. As the cylinder rods 54 extend, the tilt bars 57 are rotated counterclockwise and the elements 67 are caused to move to the release position shown in FIG. 6A, ready for reception of the tail end of the plate 7. The operator then places the tail end of the plate onto the top ends of the tilt bars 57 ready for clamping. The foot switch is then released and air is exhausted from the cylinders 52 causing the piston rods 54 to retract allowing the compression springs 74 to move the elements 67 into the clamping position shown in FIG. 6. The tilt bars and clamping mechanisms are then rotated away from the edge of the cylinder 1 under tension of the springs 66 thus applying tension on the printing plate 7 causing it to lay flat against the cylinder. This procedure is, of course, reversed when it is desired to remove the plate form the printing cylinder.

Although a preferred embodiment of the invention has been shown and described herein with certain specific modifications, it is understood that the present disclosure is made by way of example and that various other embodiments and modifications are possible without departing from the inventive concept and are included within the scope of the following claims, which claimed subject matter is regarded as the invention. The aim of the appended claims therefore, is to cover all such changes and modifications as fall within the true spirit and scope of the invention.

What is claimed is:

1. A plate clamping system for clamping a flexible plate on a rotary cylinder comprising in combination;

a first clamping assembly on said cylinder for engaging a first end of said plate, said first clamping assembly including linkage for moving said assembly between clamped and released positions, and a first fluid pressure actuator therefor, a second clamping assembly on said cylinder for engaging the opposite end of said plate, said second clamping assembly including linkage for moving said assembly between a clamped position holding said plate in tension and a released position, and a second fluid pressure actuator therefor, and fluid pressure control means remote from said cylinder for controlling application and release of fluid pressure separately to said first and second fluid pressure actuators.

2. A plate clamping system for clamping a flexible plate on a rotary cylinder, said plate having a leading end and a trailing tail end in the direction of rotation of said cylinder, comprising in combination;

a spring released plate clamp assembly on said cylinder for engaging the leading end of the plate, a first fluid pressure actuator on said plate clamp assembly for holding said plate clamp assembly in the engaged position against spring pressure, a first fluid pressure control unit remote from said cylinder for controlling application and release of fluid pressure to said first actuator, a spring actuated tail clamp assembly on said cylinder for engaging the tail end of said plate and tensioning said plate on the surface of the cylinder, a second fluid pressure actuator on said tail clamp assembly for releasing said tail clamp and relieving tension on said plate against spring pressure, and a second fluid pressure control unit remote from said cylinder for controlling application and release of fluid pressure to said second actuator.

3. In a plate clamping system for clamping and tensioning a flexible printing plate on the surface of a rotary printing cylinder, said cylinder including an axially extending gap in the wall thereof and said printing plate having a leading end and a trailing tail end in the direction of rotation of said cylinder, the combination comprising;

a plate clamp assembly mounted on the cylinder wall in said gap and having a pivotally mounted plate clamp element, said plate clamp element having a released position and a clamped position for engaging the leading end of said plate, a first fluid pressure actuator carried by said plate clamp assembly for holding said plate clamp element in the clamped position, spring means carried by said plate clamp assembly for moving the plate clamp element to the released position, a first fluid pressure control unit connected to said first fluid pressure actuator and located remote from said cylinder for controlling the application and release of fluid pressure to said first actuator, a tail clamp assembly mounted on the cylinder wall in said gap adjacent said plate clamp assembly and including a pivotally mounted tail clamp element having a released position and a clamped position for engaging the tail end of said plate, linkage for moving said tail clamp element between a first tension release position and a second position for tensioning the plate on the surface of the printing cylinder while in said clamped position, said tail clamp assembly including spring means for moving said tail clamp to the clamped position and for operating said linkage to apply tension on said plate, a second fluid pressure actuator carried by said tail clamp assembly for moving said tail clamp element to the released position and to move said linkage to said first position to release tension on said plate, a second fluid pressure control unit connected to said second fluid pressure actuator and located remote from said cylinder for controlling the application and release of fluid pressure to said second actuator, whereby an operator may control said first fluid pressure actuator to release said plate clamp element to receive the leading end of a printing plate and then return to a pressure applied clamp position, rotate said cylinder to wrap the plate thereon, and then control said second fluid pressure actuator to release said tail clamp to receive the tail end of the plate and then to apply spring pressure to clamp the tail end and tension the plate on the cylinder in a single operation.

4. The combination according to claim 3 wherein said first and second fluid pressure control units include first and second foot pedal operated control valves respectively.

5. A plate clamp for clamping the end of a printing plate on a printing cylinder, said cylinder having a longitudinal gap in the wall thereof for mounting said plate clamp, comprising in combination;

a mounting bar adapted for connection to said cylinder wall in said gap, a clamping element pivotally mounted on said bar and including a plate contact member for clamping said plate against said mounting bar and an operating arm therefor, spring means connected to said operating arm for holding the plate contact member in a first position out of clamping engagement, cam means acting between said bar and said operating arm for moving and holding the plate contact member in a second position in clamping engagement with said plate upon actuation, and a fluid pressure actuator connected to said cam means for actuation thereof.

6. The combination according to claim 5 including;

fluid pressure control means remote from said cylinder for controlling application and release of fluid pressure to said fluid pressure actuator.

7. The combination according to claim 6 wherein said fluid pressure control means includes a foot pedal operated control valve.

8. The combination according to claim 5 wherein;

said operating arm includes a cam surface thereon for cooperation with said cam means, said cam means including an anti friction cam member in contact with said cam surface, and anti friction support means for supporting said cam member for linear movement along the surface of said mounting bar and out of contact therewith.

9. The combination according to claim 8 wherein said fluid pressure actuator comprises a pneumatic cylinder with the piston and rod thereof connected to actuate said cam means to move and hold the plate contact member in said second position in clamping engagement with said plate.

10. The combination according to claim 9 including;

foot pedal operated air pressure control means remote from said printing cylinder for controlling the application and release of air pressure to said air cylinder.

11. The combination according to claim 10 wherein said mounting bar extends substantially the length of said gap and further including a plurality of said plate clamps spaced along the length thereof for engaging said plate, the pneumatic cylinders of each said clamp being connected to a common air pressure source controlled by said air pressure control means for simultaneous actuation.

12. Apparatus for clamping the end of a printing plate on a printing cylinder and applying tension thereto comprising in combination;

a tilt bar mounted for movement between a plate tensioning and a release position, a clamp element mounted on said tilt bar for movement between a clamped position in engagement with said plate and a release position;

first spring means for moving said clamp element to the clamping position, second spring means for moving said tilt bar to the plate tensioning position when said clamp is engaged, and a fluid pressure actuator connected to move said tilt bar to the released position against said second spring and then to move said clamp to the released position against said first spring.

13. The combination according to claim 12 including a fluid pressure control unit connected to said fluid pressure actuator and located remote from said cylinder for controlling application and release of fluid pressure to said actuator.

14. A clamping apparatus for clamping and applying tension on the end of a printing plate on a printing cylinder, said cylinder having a longitudinal gap in the wall thereof for mounting said apparatus, comprising in combination;

a mounting bar adapted for connection to said cylinder wall in said gap, a tilt bar pivotally mounted on said mounting bar for movement toward and away from said cylinder wall, a clamping element including a plate contact member for clamping said plate against said tilt bar, mounting structure carried by said tilt bar for pivotally mounting said clamping element relative to said tilt bar for movement between a first position in clamping engagement with said plate and a second position out of clamping engagement, first spring means for biasing said clamping element to said first position in clamping engagement with said plate, second spring means connected between said tilt bar and said mounting bar to rotate said tilt bar away from said cylinder wall to tension said printing plate when said clamping element is in said first position, and a fluid pressure actuator mounted on said mounting bar for overcoming the bias of said first and second spring means to first release the tension on said plate and then move said plate contact member out of engagement.

15. The combination according to claim 14 including;

fluid pressure control means remote from said cylinder for controlling application and release of fluid pressure to said fluid pressure actuator.

16. The combination according to claim 15 wherein said fluid pressure control means includes a foot pedal operated control valve.

17. The combination according to claim 14 including;

linkage means pivotally connected to said clamping element and including a pressure bar in contact with said fluid pressure actuator for movement thereby, said first spring means acting between said pressure bar and said mounting structure to normally hold said clamping element in clamping engagement, said fluid pressure actuator moving said pressure bar against said first spring means to release said clamping element upon actuation thereof.

18. The combination according to claim 17 wherein;

said fluid pressure control means includes a foot pedal operated control valve for controlling the application and release of fluid pressure to said actuator.

19. The combination according to claim 18 wherein said mounting bar extends substantially the length of said gap and further including;

a plurality of said clamping apparatus spaced along the length thereof for engaging said plate, the fluid pressure actuator of each said clamping apparatus being connected to a common fluid pressure source controlled by said fluid pressure control valve.

* * * * *